US006045149A

United States Patent [19]

Chonier et al.

[11] Patent Number: 6,045,149

[45] Date of Patent: Apr. 4, 2000

[54] BEARING PLATE FOR SAFETY BINDING

[75] Inventors: Frédéric Chonier, Nevers; Daniel Rocca, Chanoz-Chatenay, both of France

[73] Assignee: Look Fixations S.A., Nevers, France

[21] Appl. No.: 09/074,735

[22] Filed: May 8, 1998

[30] Foreign Application Priority Data

May 13, 1997 [FR] France ..... 97 06202

[51] Int. Cl.[7] ..... A63C 9/085

[52] U.S. Cl. ..... 280/636; 280/607

[58] Field of Search ..... 280/636, 611, 280/633, 634, 623, 609, 607

[56] References Cited

U.S. PATENT DOCUMENTS

| | | | |
|---|---|---|---|
| 4,974,867 | 12/1990 | Rullier et al. | 280/609 |
| 5,092,622 | 3/1992 | Wlader et al. | 280/636 |
| 5,215,326 | 6/1993 | Baron et al. | 280/636 |
| 5,344,180 | 9/1994 | Lancon et al. | 280/634 |
| 5,560,634 | 10/1996 | Challande et al. | 280/634 |
| 5,775,716 | 7/1998 | Harsanyi et al. . | |

*Primary Examiner*—Brian L. Johnson
*Assistant Examiner*—Bryan Fischmann
*Attorney, Agent, or Firm*—Bugnion S.A.; John Moetteli

[57] ABSTRACT

A bearing plate for a front binding, equipped with a member (8) for retaining the boot via a part of the sole (10) resting on the bearing plate (1), this bearing plate being compressible so as to adapt to the variations in thickness of the sole. The bearing plate forms a nonlinear system comprising an elastic body (12) which is precompressed on a rigid base (11) and opposes the deformation of the elastic body beyond a certain degree of deformation, so as to form a nonlinear system.

5 Claims, 3 Drawing Sheets

FIG.1
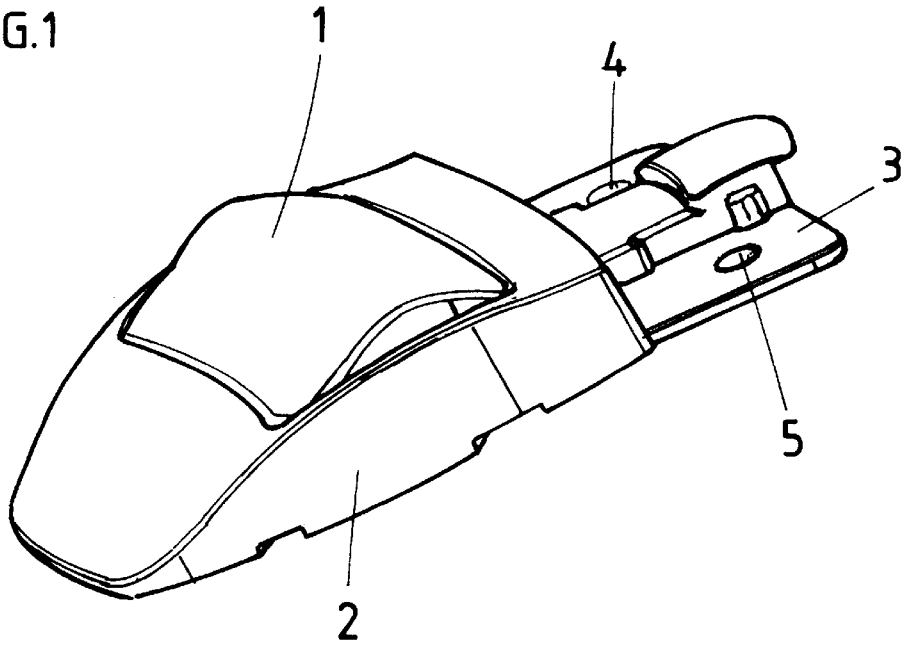
FIG. 4
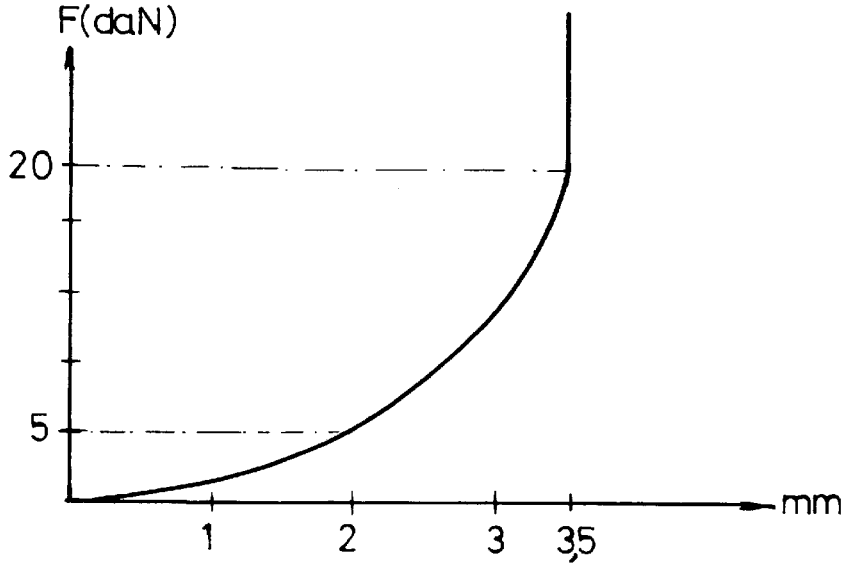
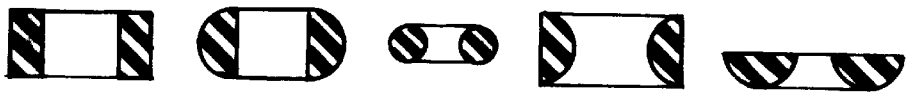
FIG. 5

BEARING PLATE FOR SAFETY BINDING

FIELD OF THE INVENTION

The present invention relates to a bearing plate for a safety binding securing the front end of a ski boot to a ski, this binding being equipped with a member for retaining the boot via a part of the sole which protrudes from the front end of the boot and is clamped between the retaining member and the bearing plate interposed between the ski and the boot, said bearing plate being compressible so as to adapt to the variations in thickness of the part of the sole clamped between the bearing plate and the retaining member.

Because of manufacturing tolerances, the thickness of the sole may vary by about plus or minus one millimeter. If the distance between the bearing plate and the retaining member of the binding is fixed, the force with which the sole is clamped varies with the thickness of this sole. An excessive clamping force has the effect of increasing the release values of the safety binding and therefore compromises the skier's safety. This is also the case when a binding which was initially adjusted for a child's sole is used by an adult.

PRIOR ART

Patent FR 2 655868 discloses a bearing plate consisting of a support plate which is integral with a base plate and is connected to this base plate by a bent part forming an elastic hinge. After repeated flexions, a hinge of this type presents risks of breaking due to fatigue of the material. Further, a bearing plate of this type presents a substantially constant resistance throughout its flexion travel. Now, it would be expedient for the force with which the sole is clamped by the binding to be higher for an adult than for a child. This is because a child is substantially less heavy than an adult, so that the adaptation of the level of the bearing plate to the variations in the thickness of the sole which are due to manufacturing tolerances would need to take place more easily than for an adult. It would therefore be desirable for the resistance of the bearing plate to pressure to increase with pressure. Take-up of the thickness tolerances of soles by an elastic means is also provided by document DE-A-32 30186.

In document WO 91/08808, it is proposed to interpose a layer of damping material between a bearing plate and the ski, it being possible for this damping material to have a progressive stiffness as a function of its compression, because of its shape or the material which forms it. The sole purpose of this material is to damp shocks and vibrations, but a bearing plate of this type will also have a tendency to adapt, in certain cases, to a variation in the thickness of the sole.

SUMMARY OF THE INVENTION

The object of the invention is to produce a bearing plate which adapts systematically to the variations in the thickness of the sole, in particular both to the soles of a child's boot and to the soles of an adult's boot, while presenting greater resistance to an adult's weight than to a child's weight and also being capable of withstanding repeated deformations without fatigue.

The bearing plate according to the invention is one which comprises an elastic body which is precompressed between a rigid mobile element intended to support the sole and a base connected to the ski, and means for limiting the deformation of the elastic body, these means consisting of at least one rigid face which opposes the free deformation of the elastic body, in at least one direction, beyond a certain deformation of this elastic body, so as to form a nonlinear system whose resistance to pressure is relatively small in a first range of deformation and is substantially higher in a second range of deformation.

According to one embodiment, the elastic body is in the form of a sleeve surrounding a rigid base, this base having at least approximately the form of a truncated pyramid or cone opposing the deformation of the sleeve beyond a certain degree of deformation.

The rigid element resting on the elastic body is advantageously surrounded and retained vertically by a retaining body fixed to the ski.

The bearing plate according to the invention makes it possible to obtain relatively low resistance to pressure in a first range of deformation, for example two millimeters, and a substantially higher resistance to pressure for a deformation exceeding two millimeters, for example between 2 millimeters and 3.5 millimeters, which values correspond to the maximum thickness of the sole of a boot for an adult. The level of the bearing plate, and with it the force by which the sole is clamped, will therefore adapt more easily to the variations in thickness of the sole of a boot for children.

BRIEF DESCRIPTION OF THE DRAWINGS

The appended drawing represents, by way of example, two embodiments of the bearing plate according to the invention.

FIG. 1 is a perspective view, without the binding, of the first embodiment.

FIG. 4 represents the ideal deformation curve of the bearing plate as a function of the force exerted on this bearing plate.

FIG. 5 represents some alternatives for the cross section of the elastic body.

DESCRIPTION OF THE PREFERRED EMBODIMENTS

FIG. 1 shows a rigid element 1 which is surrounded and retained vertically by a retaining body 2, extended to the front by a part 3 in the form of a plate by which the body 2 can be fixed on a ski using two screws passing through holes 4 and 5. Once fitted, the binding will cover the part 3.

Figure 2:
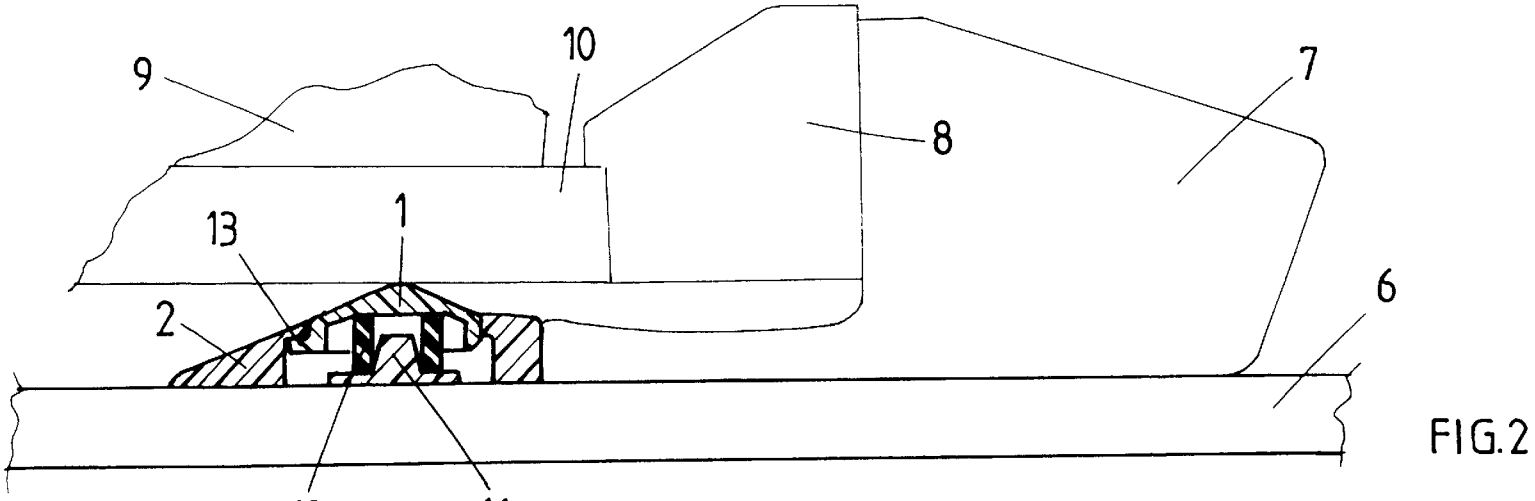
FIG. 2 represents a view in vertical longitudinal section thereof, along the plane of symmetry, with the binding represented and the front of a child's boot engaged in the binding, these being represented by thin lines.
Figure 3:
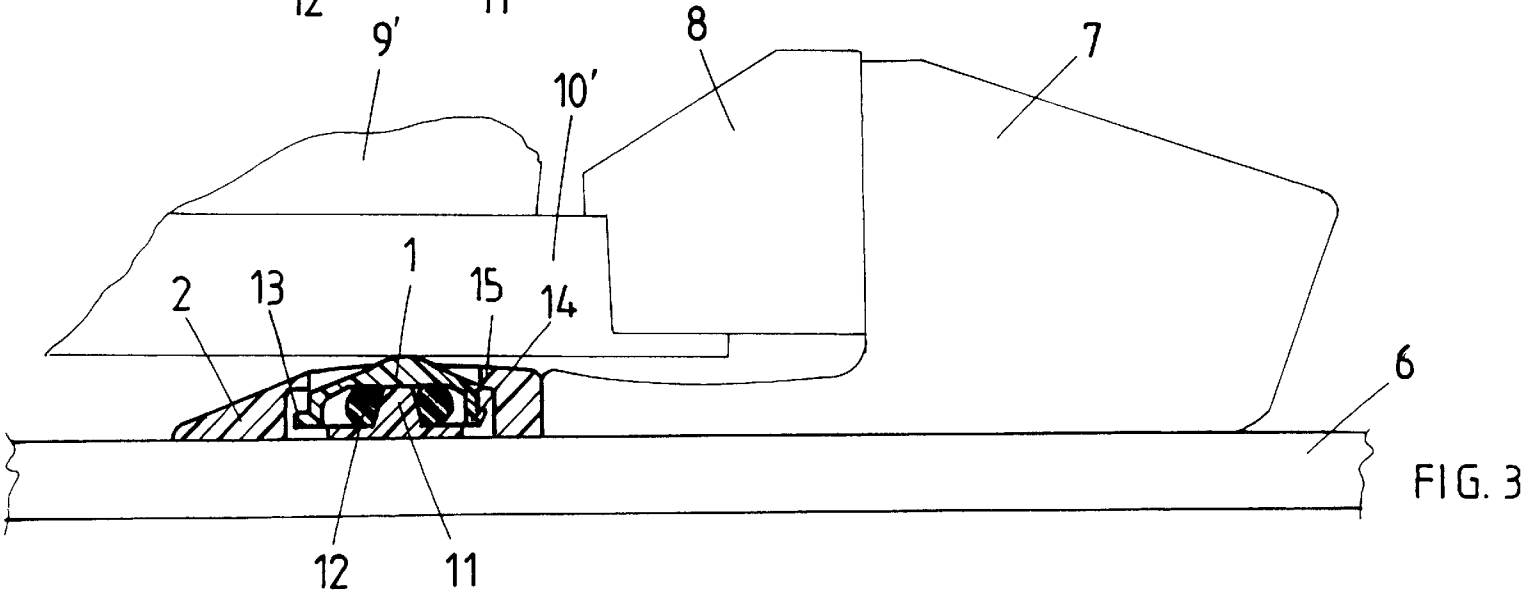
FIG. 3 is a similar view to FIG. 2, with an adult's boot engaged in the binding.

FIGS. 2 and 3 illustrate an example of applying the first method.

FIG. 2 represents the bearing plate fixed on a ski 6 with a binding body 7 including a retaining member 8 which, in known fashion, retains a boot 9 via its sole 10 which protrudes from the front end of the boot. The central part of the bearing plate is occupied by a base 11 in the form of a truncated pyramid with four faces. A sleeve 12 of elastic material is arranged around this base, the height of which sleeve is greater than the height of the base 11. Via its bottom, the base 11 positions the sleeve 12 transversely, while its inclined faces allow the sleeve to deform in the direction of its axis.

The rigid element 1 is retained in the retaining body 2, on the one hand, by a hook 13 and, on the other hand, by a lug 14 which catches under an engaging surface 15 of the retaining body 2.

The sleeve 12 is made of elastic material, for example SBS (Styrene Butadene Styrene), SEBS (Styrene Ethylene-Butadene Styrene, PDM (Polydimethylsiloxane), EPM (Ethylene Propylene Monomer), TPU (Thermoplastic Urethane) or natural or synthetic rubber. This material can also be a material which yields and thus is relatively inelastic.

In order to fit the rigid element 1, it is necessary for the sleeve 12 to be compressed to a certain degree. In the position represented in FIG. 2, the sleeve 12 is therefore slightly precompressed, so that the bearing plate already presents some resistance to compression. In the same figure, the thickness of the sole 10 of the child's boot which is represented is minimal, and the precompression of the sleeve 12 presents sufficient resistance to prevent the rigid part 1 from moving downward. If the sole 10 is slightly thicker, this variation in thickness will be taken up by the sleeve 12, the compression of the sleeve resulting merely in a slight increase in the force by which the sole is clamped, an increase which will have no effect on the ability of the binding to release.

It should be recalled here that the sole of the boot is inserted obliquely under the retaining member 8 of the binding, which constitutes the fulcrum of a lever consisting of the boot that compresses the bearing plate, on the one hand, under the effect of the skier's weight and, on the other hand, under the effect of the rear binding element which holds the heel of the boot against the ski.

When the child's boot 9 is replaced by an adult's boot 9', provided with a sole 10' which is thicker than the sole 10 of the child's boot, the bearing plate, that is to say the sleeve 12, is subjected to a relatively high pressure. The sleeve 12 deforms transversely both inward and outward, and the sides of the base 11 soon oppose the inward deformation, so that the resistance of the sleeve 12 to the deformation increases rapidly. When the pressure is sufficient, the rigid element 1 abuts against the base 11, this maximum lowering of the bearing plate corresponding to a maximum thickness of the sole 10'.

FIG. 4 represents the shape of the variation of the force F exerted on the bearing plate, which force is given in daN, as a function of the crushing of the bearing plate. Starting from the origin, the curve which is represented has a first part, of shallow slope, extending approximately up to two millimeters of crushing. This region of the curve corresponds to a child's boot sole. The two millimeter crushing is already obtained for a force of about 5 daN. Beyond two millimeters of crushing, the slope of the curve increases rapidly. This region corresponds to crushing by an adult's boot. It extends over a range of from about 5 to 20 daN. The maximum crushing in question is 3.5 millimeters, corresponding to the position represented in FIG. 3.

The cross section of the sleeve could have a form other than the rectangular one which is represented. A few examples are represented in FIG. 5.

The nonlinearity of the pressure/deformation relationship is generally obtained by means for limiting the deformation of an elastic body, these means consisting of at least one rigid face which opposes the free deformation of the homogeneous elastic body, in at least one direction beyond a certain deformation, that is to say a certain degree of deformation.

Figure 6:
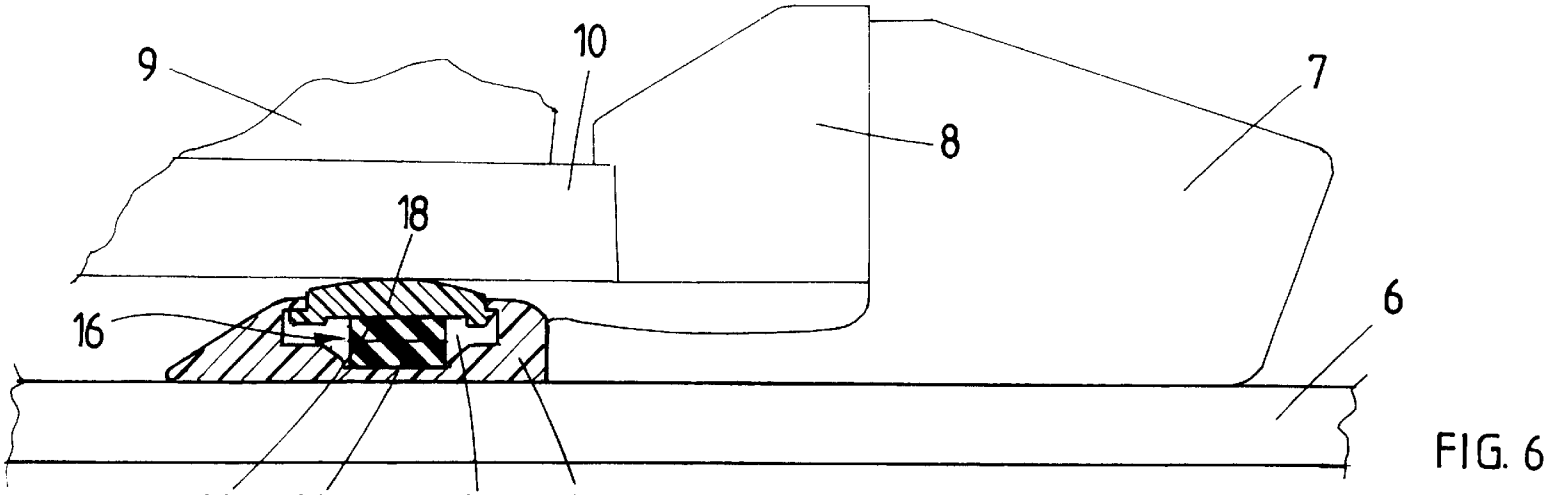
FIG. 6 is a view in longitudinal section of a second embodiment with a child's sole.
Figure 7:
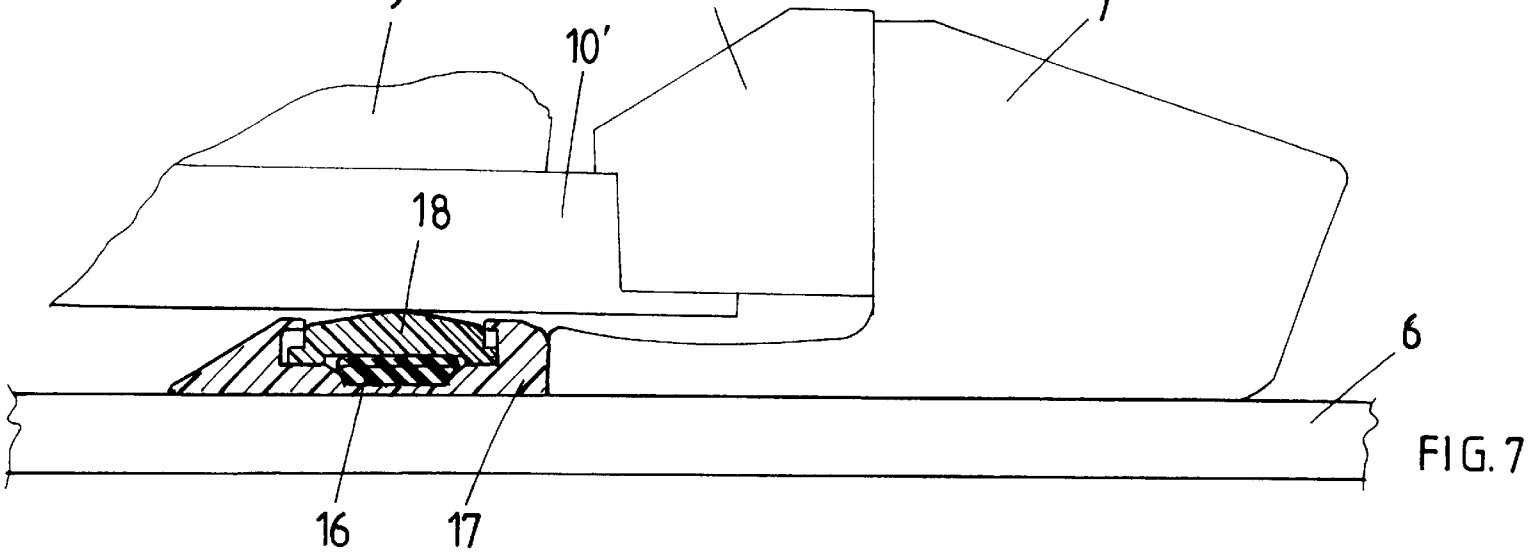
FIG. 7 is a similar view to FIG. 5 with an adult's sole.

According to the second embodiment, represented in FIGS. 6 and 7, the elastic body 16, in the form of a stud, consists of two superimposed materials **16*a* and 16*b* with different hardnesses. In the example in question, the upper layer 16*a* has a substantially lower hardness than the layer 16*b*. The elastic body 16*b* is mounted in a hollow of a base 17 fixed to the ski 6, and is precompressed by a rigid element 18 mounted and retained in the base 17 like the element 1 in the first embodiment. The bottom of the base 17 in which the elastic element 16 rests forms an obliquely walled dish 19. The size of this dish 19 is such that, when the relatively hard layer 16*b*** deforms, the dish opposes the transverse expansion of the elastic body.

In FIG. 6, the boot 9 is again a child's boot, while in FIG. 7, the boot 9' is an adult's boot. The thickness of the sole 10 in FIG. 6 is a minimum thickness. The precompressed elastic body 16 is substantially undeformed by the engagement of a boot. If the thickness of the sole 10 is slightly greater than represented, the upper layer **16*a* of the elastic body 16** deforms so as to take up this difference in thickness.

The sole 10' represented in FIG. 7 has a maximum thickness. The bearing element 18 is at its lowermost level, bearing on the base 17, and the elastic body 16 is greatly deformed.

What is claimed is:

1. A bearing plate for a safety binding, the bearing plate securing the front end of a ski boot to a ski and being equipped with a member (8) retaining the boot via a part of the sole (10) which protrudes from the front end of the boot and which is clamped between the retaining member and the bearing plate, the bearing plate being interposed between the ski and the boot so as to support the boot, via an upward pressure against the bottom of the sole of the boot, said bearing plate being compressible so as to help stabilize the boot in the binding and adapt to the variations in thickness of the part of the sole clamped between the bearing plate and the retaining member, which bearing plate comprises an elastic body (12; 16) which is precompressed between a rigid mobile element (1; 18) intended to support the sole and a rigid base (11; 17) connected to the ski, and means (11; 19) for limiting the deformation of the elastic body, these means consisting of at least one rigid face which opposes the free deformation of the elastic body, in at least one direction, beyond a certain deformation of this elastic body, so as to form a nonlinear system whose resistance to pressure is relatively small in a first range of deformation and is substantially higher in a second range of deformation.

2. The bearing plate as claimed in claim 1, wherein the elastic body is in the form of a sleeve (12) surrounding a part (11) of the base.

3. The bearing plate as claimed in claim 2, wherein the base part (11) surrounded by the elastic body is at least approximately in the form of a truncated pyramid or cone.

4. The bearing plate as claimed in claim 1, wherein the rigid element (1; 18) resting on the elastic body is surrounded and retained vertically by a retaining body (2; 17) fixed to the ski.

5. The bearing plate as claimed in claim 1, wherein the elastic body (12; 16) has a resistance to crushing which increases substantially beyond crushing by about 2 millimeters.

* * * * *